US011134744B2

(12) United States Patent
Mariacher

(10) Patent No.: US 11,134,744 B2
(45) Date of Patent: Oct. 5, 2021

(54) CLIMBING SHOE

(71) Applicant: CALZATURIFICIO S.C.A.R.P.A S.p.A., Asolo (IT)

(72) Inventor: Heinz Mariacher, Asolo (IT)

(73) Assignee: CALZATURIFICIO S.C.A.R.P.A.S.p.A.

( * ) Notice: Subject to any disclaimer, the term of this patent is extended or adjusted under 35 U.S.C. 154(b) by 172 days.

(21) Appl. No.: 16/419,484

(22) Filed: May 22, 2019

(65) Prior Publication Data

US 2019/0373980 A1 Dec. 12, 2019

(30) Foreign Application Priority Data

May 23, 2018 (IT) ..... 102018000005617

(51) Int. Cl.
*A43B 5/00* (2006.01)
*A43B 23/02* (2006.01)
(Continued)

(52) U.S. Cl.
CPC ..... *A43B 5/003* (2013.01); *A43B 13/04* (2013.01); *A43B 13/16* (2013.01); *A43B 23/0215* (2013.01); *A43B 23/0295* (2013.01)

(58) Field of Classification Search
CPC ..... A43B 5/003; A43B 13/16; A43B 13/22; A43B 13/04; A43B 23/0295;
(Continued)

(56) References Cited

U.S. PATENT DOCUMENTS

2003/0196350 A1* 10/2003 Chu ..... A43B 3/06 36/58.5
2004/0111921 A1* 6/2004 Lenormand ..... A43B 5/003 36/45
(Continued)

FOREIGN PATENT DOCUMENTS

EP 2274994 1/2011
EP 2949231 12/2015
(Continued)

OTHER PUBLICATIONS

Italian Search Report—Ministero dello Sviluppo Economico IT Application No. IT2018000005617, dated May 23, 2018, pp. 1-7.

*Primary Examiner* — Ted Kavanaugh
(74) *Attorney, Agent, or Firm* — The Belles Group, P.C.

(57) ABSTRACT

A climbing shoe comprising: a shoe-upper shaped so as to completely cover the foot of the user; a sole which is fixed to the bottom of the shoe-upper so as to cover the front part of the bottom; a rear tensioning band made of elastomeric material, which is substantially U-bent and is fixed to the rear part of the shoe-upper so as to cover the area of the shoe-upper immediately above the heel portion of the shoe-upper, and then to extend obliquely along the two lateral sides of the shoe-upper towards the sole; and a substantially ribbon-like sagittal tensioning band made of elastomeric material, which extends longitudinally on the bottom part of the shoe-upper, from the tip of the shoe-upper up to the rear tensioning band crossing, in succession, the bottom and the heel portion of the shoe-upper while remaining underneath the sole, and which is firmly fixed to the shoe-upper substantially along its entire length.

14 Claims, 3 Drawing Sheets

(51) Int. Cl.
*A43B 13/16* (2006.01)
*A43B 13/04* (2006.01)

(58) Field of Classification Search
CPC ..... A43B 23/0265; A43B 23/027; A43B 23/0215; A43B 23/0255
See application file for complete search history.

(56) References Cited

U.S. PATENT DOCUMENTS

| | | | | |
|---|---|---|---|---|
| 2004/0244226 | A1* | 12/2004 | Farys | A43B 7/20 36/140 |
| 2005/0138848 | A1* | 6/2005 | Fullerton | A43B 13/146 36/113 |
| 2015/0342290 | A1* | 12/2015 | Mariacher | A43B 13/16 36/114 |
| 2015/0342291 | A1* | 12/2015 | Mariacher | A43B 13/16 36/114 |
| 2015/0342292 | A1* | 12/2015 | Mariacher | A43B 13/42 36/114 |
| 2017/0049186 | A1* | 2/2017 | Lee | A43B 5/003 |
| 2018/0317592 | A1* | 11/2018 | Rudolf | D04B 1/24 |
| 2019/0373979 | A1* | 12/2019 | Mariacher | A43B 5/003 |
| 2019/0373980 | A1* | 12/2019 | Mariacher | A43B 13/04 |
| 2020/0170332 | A1* | 6/2020 | Mariacher | A43B 13/04 |

FOREIGN PATENT DOCUMENTS

| | | |
|---|---|---|
| EP | 2949232 | 12/2015 |
| EP | 2949233 | 12/2015 |

* cited by examiner

CLIMBING SHOE

CROSS-REFERENCE TO RELATED APPLICATIONS

This patent application claims priority from Italian patent application no. 102018000005617 filed on May 23, 2018, the entire disclosure of which is incorporated herein by reference.

TECHNICAL FIELD

The present invention relates to a climbing shoe.

BACKGROUND ART

As is known, some models of climbing shoes available on the market comprise: a leather and/or fabric shoe-upper which is substantially sock-shaped so as to accommodate and cover the foot of the user, including the sole of the foot; a front tensioning band made of high-elasticity elastomeric material, which is substantially U-bent and is fixed by gluing to the tip of the shoe-upper so as to surround the tarsus-phalangeal portion of the user's foot; a rear tensioning band made of high-elasticity elastomeric material, which is substantially U-bent and is fixed by gluing to the rear part of the shoe-upper so as to cover the region above the heel of the user's foot, and then extends along the two lateral sides of the shoe-upper up to reach and join the front tensioning band; and a sole made of soft and flexible polymeric material with a high friction coefficient and substantially inextensible, which is fixed by gluing to the bottom of the shoe-upper so as to only cover the front part of the bottom of the shoe-upper, locally overlapping the front tensioning band.

Moreover, in patent application EP 2949232 A1, the climbing shoe is moreover provided with a rear sole that is discrete and spaced from the front sole, and with a medial tensioning band.

The rear sole is made of soft and flexible polymeric material with a high friction coefficient and substantially inextensible, and is fixed to the bottom of the shoe-upper by gluing so as to only cover the talus-calcaneal portion of the bottom of the shoe-upper.

The medial tensioning band is made of a high-elasticity elastomeric material, has a ribbon-like structure and, lastly, is fixed to the bottom of the shoe-upper by gluing so as to extend straddling the centreline of the bottom of the shoe-upper, from the tarsus-phalangeal portion to the talus-calcaneal portion of the bottom of the shoe-upper.

The purpose of the medial tensioning band is to oppose, while climbing, to the extension of the shoe-upper and to the straightening of the forefoot of the user, in order to improve the shoe's capacity to support the foot.

SUBJECT-MATTER OF THE INVENTION

Aim of the present invention is to provide a climbing shoe that is capable of embracing the climber's foot in a more complete and effective manner, improving the shoe's capacity to support the foot and its ability to adapt to the morphology of the user's foot.

To achieve these aims, according to the present invention there is provided a climbing shoe as defined in Claim 1 and preferably, though not necessarily, in any one of the dependent claims.

BRIEF DESCRIPTION OF THE DRAWINGS

The present invention will now be described with reference to the accompanying drawings, which illustrate a non-limiting embodiment thereof, in which:

FIG. 3 is a view of the rear part of the climbing shoe shown in FIG. 1; whereas

PREFERRED EMBODIMENT OF THE INVENTION

Figure 1:
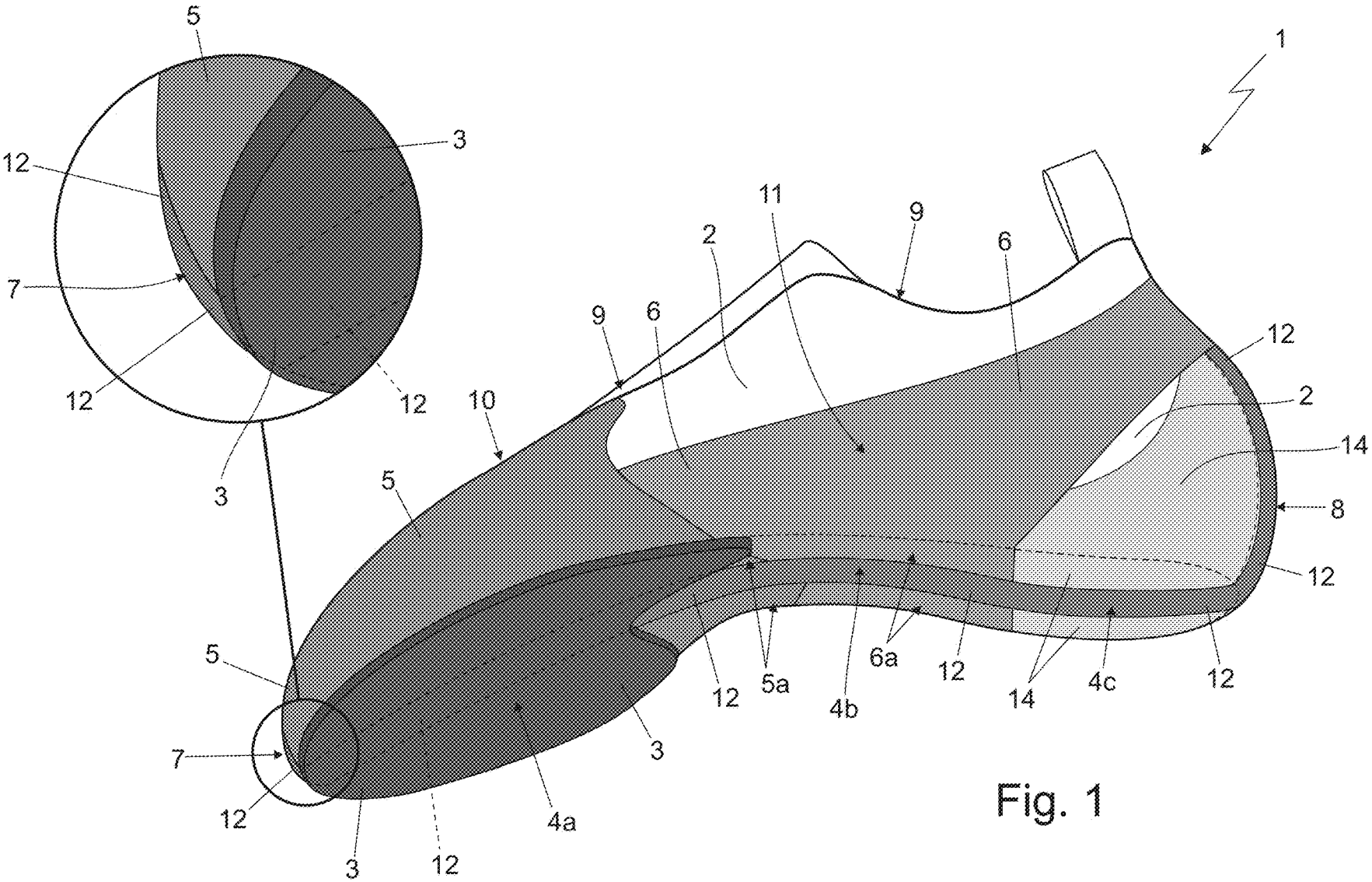
FIG. 1 is a perspective and schematic view of a climbing shoe realized according to the teachings of the present invention.

With reference to FIGS. 1, 2, 3 and 4, reference number 1 denotes as a whole a climbing shoe that may be particularly advantageously used for climbing on rock walls classified as grade IV or higher.

The climbing shoe 1 basically comprises: a shoe-upper 2 preferably made of leather and/or fabric, which is substantially sock-shaped so as to accommodate and completely cover the foot of the user, including the sole of the foot; and a front sole 3 which is made of a soft and flexible polymeric material with a high friction coefficient and preferably also substantially inextensible, and which is firmly fixed to the bottom 4 of the shoe-upper 2, preferably by gluing, so as to cover the front part of the bottom 4 of shoe-upper 2.

More in detail, the bottom 4 of shoe-upper 2, i.e. the part/sector of shoe-upper 2 that covers the sole of the user's foot, is longitudinally divided into a front or tarsus-phalangeal portion 4*a* that is immediately underneath the tarsus-phalangeal region of the sole of the user's foot; a central or plantar-arch portion 4*b* immediately underneath the plantar-arch region; and a rear or talus-calcaneal portion 4*c* immediately underneath the talus-calcaneal region of the sole of the user's foot.

The front sole 3 is preferably shaped/dimensioned so as to cover the tarsus-phalangeal portion 4*a* and optionally also a limited part of the plantar-arch portion 4*b* of the bottom 4 of shoe-upper 2.

Preferably, the front sole 3 is furthermore made of a polymeric material having a hardness (UNI 4916) preferably less than 80 ShoreA and optionally ranging between 60 and 75 ShoreA.

More in detail, in the example shown, the front sole 3 is preferably made of a soft and flexible polymeric material, such as—for example—the XS Edge compound or the GRIP 2 compound manufactured by the Italian firm VIBRAM S.P.A.

The climbing shoe 1 additionally comprises a plurality of tensioning bands that are made of high elasticity elastomeric materials, and are firmly fixed to the shoe-upper 2 preferably by gluing, so as to embrace and tighten the shoe-upper 2 on the foot of the user.

More in detail, each tensioning band has a monolithic structure, and is made of an elastomeric material with an elastic modulus (also known as Young's modulus) significantly lower than that of the polymeric material forming the front sole 3.

Preferably the tensioning band or bands are moreover pre-tensioned in order to embrace and firmly tighten the shoe-upper 2 on the foot of the user, preferably so as to also bend/curve the tiptoe of the user's foot downwards.

With reference to FIGS. 1, 2, 3 and 4, in particular, the climbing shoe 1 is preferably provided with a front tensioning band 5 and with a rear tensioning band 6, both preferably pre-tensioned.

The front tensioning band 5 encloses the tip 7 of shoe-upper 2. The rear tensioning band 6, on the other hand, encloses the rear part of the shoe-upper 2, while remaining above the heel portion 8 of the shoe-upper 2, i.e. while remaining above the portion of shoe-upper 2 that covers the rear end of the calcaneus of the user's foot.

Preferably, furthermore, the tensioning bands 5 and 6 are made of elastomeric materials having an elastic modulus 2-10 times lower than that of the polymeric material forming the sole 3, and preferably also a hardness (UNI 4916) greater than that of the polymeric material forming the sole 3.

Figure 2:
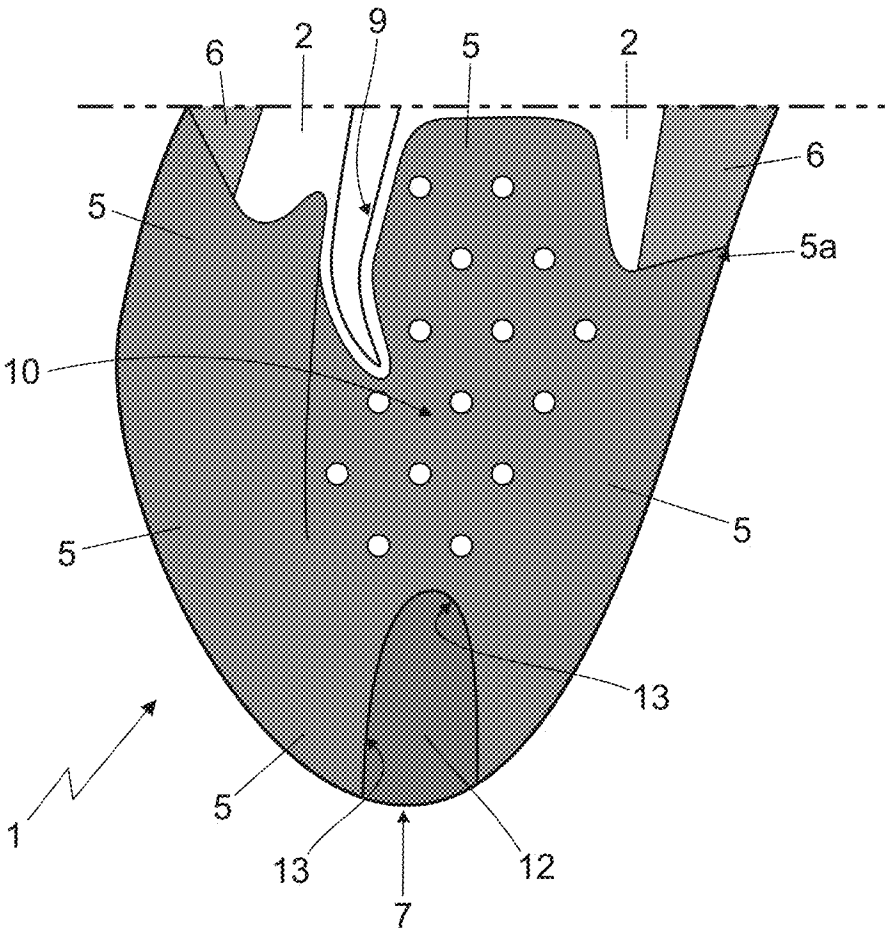
FIG. 2 is a view of the anterosuperior part of the climbing shoe shown in FIG. 1.
Figure 4:
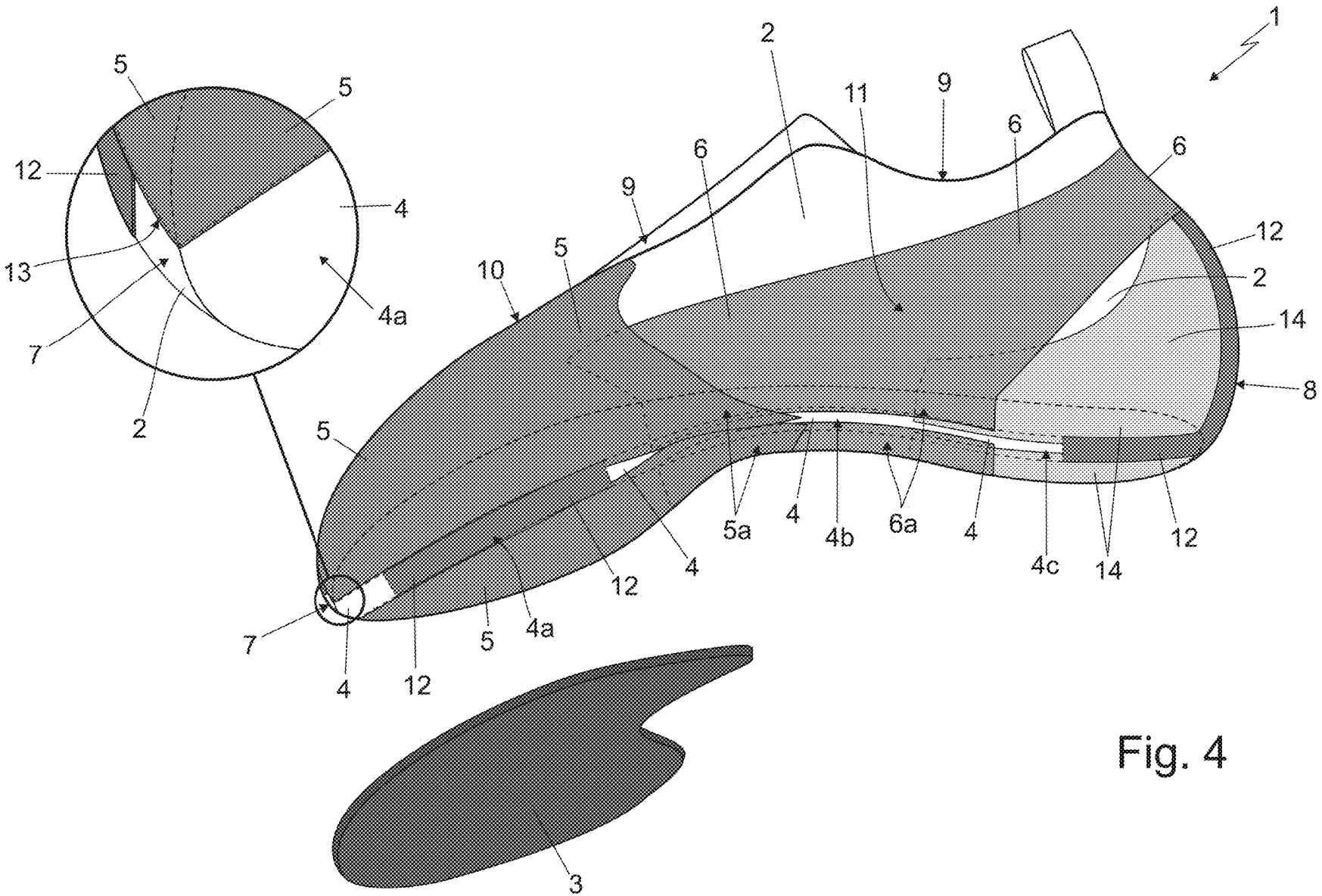
FIG. 4 is a partially exploded view of the climbing shoe shown in FIG. 1, with parts in transparency and parts removed for the sake of clarity.

With reference to FIGS. 1, 2 and 4, in particular, the front tensioning band 5 is substantially U-bent and is firmly fixed to the tip 7 of shoe-upper 2, preferably by gluing, so as to surround the front part of the bottom 4 of shoe-upper 2, while firmly joining the front sole 3 preferably by gluing.

More in detail, the front tensioning band 5 is firmly fixed to the tip 7 of shoe-upper 2 so as to cover the region of shoe-upper 2 that surrounds/flanks the tarsus-phalangeal portion 4*a* of the bottom 4 of shoe-upper 2, preferably also extending/prolonging on the bottom 4 of shoe-upper 2, underneath the sole 3.

Preferably, the two ends 5*a* of front tensioning band 5 moreover extend/prolong along the bottom 4 of shoe-upper 2 one towards the other, preferably so as to firmly join to one another roughly at the boundary between the tarsus-phalangeal portion 4*a* and the plantar-arch portion 4*b* of bottom 4, optionally also locally overlapping one another.

Moreover, with reference to FIG. 2, the central part of front tensioning band 5 is preferably also shaped so as to extend along the upper part of shoe-upper 2 towards the instep of the user's foot, preferably roughly up to reach and optionally surround the front end of the top fitting opening 9 of shoe-upper 2, so as to cover the anterosuperior part 10 of shoe-upper 2 substantially without interruptions.

The front part of the user's foot is thus inferiorly protected by the sole 3 and superiorly protected by the central part of front tensioning band 5.

Preferably, the front tensioning band 5 is lastly made of an elastomeric material with a hardness (UNI 4916) greater than or equal to 80 ShoreA.

With reference to FIGS. 1, 2, 3 and 4, the rear tensioning band 6, in turn, is substantially U-bent and is firmly fixed to the rear part of shoe-upper 2 preferably by gluing, so as to cover the area of shoe-upper 2 immediately above the heel portion 8, and then extend obliquely along the two inner and outer lateral sides 11 of shoe-upper 2 towards the sole 3, preferably up to reach and join the front tensioning band 5 preferably by gluing.

Preferably, the two ends 6*a* of rear tensioning band 6 furthermore extend/prolong along the bottom 4 of shoe-upper 2 one towards the other, affecting the plantar-arch portion 4*b* of the bottom 4 of shoe-upper 2 and optionally also the tarsus-phalangeal portion 4*a* and/or the talus-calcaneal portion 4*c* of the bottom 4.

More in detail, the rear tensioning band 6 is preferably shaped/structured so as to reach and merge/join the two ends 5*a* of front tensioning band 5 along the two lateral sides 11 of shoe-upper 2 and/or along the bottom 4 of shoe-upper 2, preferably near the border between the tarsus-phalangeal portion 4*a* and the plantar-arch portion 4*b* of the bottom 4.

Preferably, the two ends 6*a* of rear tensioning band 6 moreover extend/prolong along the bottom 4 of shoe-upper 2 one towards the other, so as to at least partially cover the plantar-arch portion 4*b* of the bottom 4, and optionally also part of the tarsus-phalangeal portion 4*a* and/or of the talus-calcaneal portion 4*c* of the bottom 4 of shoe-upper 2.

Preferably, the two ends 6*a* of rear tensioning band 6 moreover extend along the bottom 4 of shoe-upper 2, underneath the front sole 3.

Similarly to the front tensioning band 5, also the rear tensioning band 6 is preferably made of an elastomeric material having a hardness (UNI 4916) greater than or equal to 80 ShoreA.

With reference to FIGS. 1, 2, 3 and 4, the climbing shoe 1 additionally comprises a preferably pre-tensioned, sagittal tensioning band 12 with a monolithic and ribbon-like structure, which extends longitudinally on the bottom part of shoe-upper 2, preferably substantially without interruptions from the tip 7 of shoe-upper 2 up to the rear tensioning band 6, crossing in succession the whole of bottom 4 and the heel portion 8 of shoe-upper 2, preferably while remaining substantially astride of the midplane of the shoe, and which is firmly fixed to the shoe-upper 2 substantially along its entire length preferably by gluing.

More in detail, the sagittal tensioning band 12 has a width l always less than the local width of the bottom or footbed 4 of shoe-upper 2, and extends along the bottom 4 of shoe-upper 2 remaining underneath the front sole 3 and preferably also above the front tensioning band 5 and/or rear tensioning band 6.

Preferably, the sagittal tensioning band 12 moreover merges/joins the central segment of rear tensioning band 6 preferably by gluing.

Additionally, similarly to the tensioning bands 5 and 6, also the sagittal tensioning band 12 is preferably made of an elastomeric material having an elastic modulus 2-10 times lower than that of the polymeric material forming the sole 3, and preferably also a hardness (UNI 4916) greater than that of the polymeric material forming the sole 3.

More in detail, the sagittal tensioning band 12 is longitudinally divided into a front ribbon-like segment, an intermediate ribbon-like segment and a rear ribbon-like segment.

The front ribbon-like segment is preferably bent upwards like a hook, and is firmly fixed to the shoe-upper 2 so as to protrude from the tarsus-phalangeal portion 4*a* of the bottom 4 and rise along the tip 7 of shoe-upper 2, towards the top fitting opening 9 of the shoe-upper 2 (i.e. towards the instep of the user's foot), preferably while covering the region of tip 7 located substantially astride the hallux and the second toe of the user's foot.

Preferably, the front ribbon-like segment of sagittal tensioning band 12 moreover engages a corresponding oblong cut-out 13 specifically made in the front tensioning band 5, so that the front ribbon-like segment remains always in directly contact with the shoe-upper 2. Preferably, the shape of the oblong cut-out 13 is furthermore substantially complementary to that of the front ribbon-like segment.

The intermediate ribbon-like segment of sagittal tensioning band 12, on the other hand, extends along the bottom 4 of shoe-upper 2 while remaining underneath the front sole 3 and preferably also above the front tensioning band 5 and/or the rear tensioning band 6.

More in detail, the sagittal tensioning band 12 extends along the bottom 4 of shoe-upper 2 preferably while remaining above the two ends 5*a* of the front tensioning band 5 and/or above the two ends 6*a* of the rear tensioning band 6.

Preferably, the intermediate ribbon-like segment of sagittal tensioning band 12 furthermore extends along the bottom 4 of shoe-upper 2 so as to remain substantially astride the centreline of bottom 4.

Lastly, the rear ribbon-like segment of sagittal tensioning band 12 rises along the rear part of shoe-upper 2 substantially along the central region of the heel portion 8, up to reach and join the rear tensioning band 6.

More in detail, in the example shown, the rear end of sagittal tensioning band 12 is preferably overlapped by the central segment of rear tensioning band 6, and is firmly fixed to the central segment of rear tensioning band 6 preferably by gluing.

In the example shown, in addition, the sagittal tensioning band 12 has a width l preferably ranging between 1 and 2.5 cm (centimetres). Preferably, the width l of sagittal tensioning band 12 is moreover substantially constant along the entire length of the intermediate ribbon-like segment and optionally also of the rear ribbon-like segment.

Preferably, the sagittal tensioning band 12 is lastly made of an elastomeric material with a hardness (UNI 4916) greater than or equal to 100 ShoreA.

Figure 3:
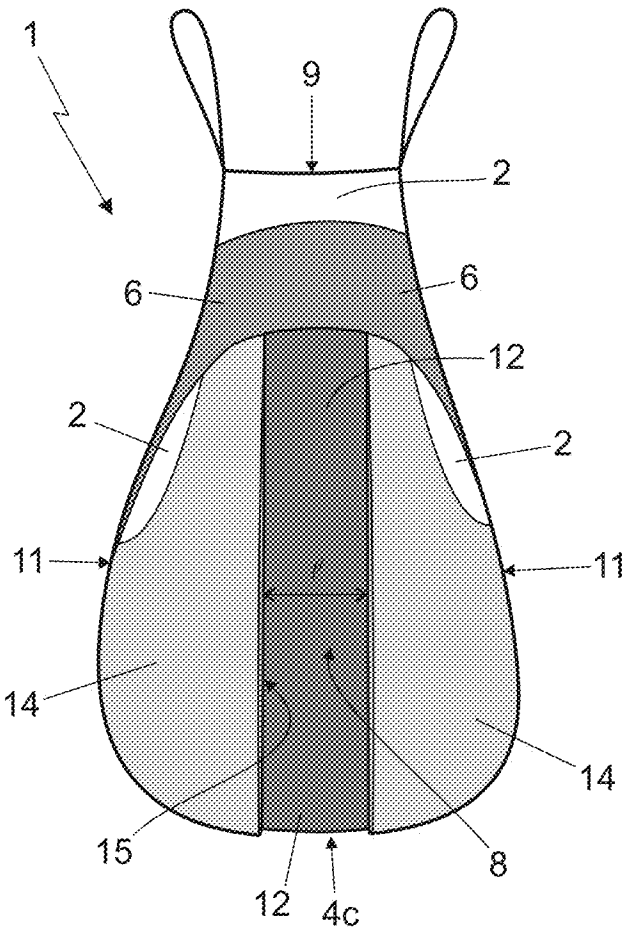

With reference to FIGS. 1, 3 and 4, lastly the climbing shoe 1 preferably also comprises a rear protective insert 14 made of soft and flexible polymeric material, which is shaped substantially like a concave shell, and is firmly fixed to the rear part of shoe-upper 2 preferably by gluing, so as to embrace and protect the calcaneus of the user's foot.

Preferably, the rear protective insert 14 is moreover shaped/dimensioned so as to extend also along the bottom 4 of shoe-upper 2 to partially cover the talus-calcaneal region 4*c* of bottom 4, optionally also extending along the plantar-arch portion 4*b* underneath the ends 6*a* of rear tensioning band 6.

The sagittal tensioning band 12, or rather the rear ribbon-like segment of sagittal tensioning band 12, in turn, extends over the rear protective insert 14, preferably while remaining substantially astride of the midplane of the shoe.

In other words, the rear protective insert 14 is adapted to cover the heel portion 8 of shoe-upper 2, to partially cover the talus-calcaneal portion 4*c* of the bottom 4 and, lastly, the areas of the two lateral sides 11 of shoe-upper 2 that flank the calcaneus of the user's foot. The sagittal tensioning band 12, on the other hand, partially extends on/overlaps the rear protective insert 14, and is firmly fixed to the rear protective insert 14 preferably by gluing.

Furthermore, the rear protective insert 14 is made of a polymeric material having a hardness (UNI 4916) greater than the hardness (UNI 4916) of the polymeric material forming the sole 3 and/or greater than the hardness (UNI 4916) of the elastomeric material forming the tensioning band 5 and/or 6 and/or 12. Additionally, the rear protective insert 14 is made of a polymeric material having an elastic modulus preferably greater than that of the elastomeric material forming the tensioning bands 5 and/or 6 and/or 12, and optionally also greater than that of the polymeric material forming the sole 3.

With particular reference to FIG. 2, preferably the rear protective insert 14 is furthermore provided with a vertical groove 15 which extends substantially straddling the midplane of the shoe, along the part of the rear protective insert 14 that covers the heel portion 8 of shoe-upper 2, preferably up to the rear tensioning band 6, and which is dimensioned so as to be able to accommodate the end part of sagittal tensioning band 12, or rather the rear ribbon-like segment of sagittal tensioning band 12.

Preferably, the vertical groove 15 is moreover dimensioned so as to entirely contain the end part of sagittal tensioning band 12, or rather the rear ribbon-like segment of sagittal tensioning band 12.

In other words, the vertical groove 15 has a depth greater than the local thickness of the sagittal tensioning band 12, or rather of the rear ribbon-like segment of sagittal tensioning band 12, so that the sagittal tensioning band 12 does not emerge outside of the rear protective insert 14.

More in detail, the shape of vertical groove 15 is preferably substantially complementary to that of the end part of sagittal tensioning band 12, or rather of the rear ribbon-like segment of sagittal tensioning band 12.

In the example shown, in particular, the rear protective insert 14 is preferably made via injection moulding, and is preferably made of an elastomeric material having a hardness (UNI 4916) preferably ranging between 80 and 130 ShoreA.

Operation of climbing shoe 1 is easily inferable from the above description, and does not require further explanation.

The benefits deriving from the presence of the sagittal tensioning band 12 are remarkable.

Experimental tests have highlighted that the presence of a sagittal tensioning band 12 extending continuously from the tip 7 of the shoe to the rear tensioning band 6, forces the tiptoe of the user's foot to more pronouncedly bend downwards, improving the shoe's capability to support the foot.

In addition, the sagittal tensioning band 12, acting directly on the tip 7 of shoe-upper 2, allows to keep the user's foot in an arched posture more matching with the morphology of the foot, making the shoe much more comfortable to wear.

It is finally clear that modifications and variations can be made to the climbing shoe 1 described and illustrated above without however departing from the scope of the present invention.

For example, the front ribbon-like segment of sagittal tensioning band 12 could overlap and be firmly fixed to the front tensioning band 5 which, in this case, would lack the oblong cut-out 13.

Furthermore, in a different embodiment, the climbing shoe 2 could comprise, instead of the rear protective insert 14, a pair of lateral protective inserts that are preferably shaped substantially like sea-shell valves, and are firmly fixed to the rear part of the shoe-upper 2 on opposite sides of the end part of sagittal tensioning band 12, or rather of the rear ribbon-like segment of sagittal tensioning band 12, so as to cover the areas of the two lateral sides 11 of shoe-upper 2 that flank the calcaneus of the user's foot.

Preferably, the two lateral protective inserts are furthermore contiguous/adjacent to the end part of sagittal tensioning band 12, or rather to the rear ribbon-like segment of sagittal tensioning band 12.

In this second embodiment, therefore, the end part of sagittal tensioning band 12, or rather the rear ribbon-like segment of sagittal tensioning band 12, is fixed directly to the shoe-upper 2 preferably by gluing, or rather to the heel portion 8 of shoe-upper 2.

The invention claimed is:

1. A climbing shoe comprising:

a shoe-upper shaped so as to completely cover a foot of a user;

a sole which is fixed to a bottom of the shoe-upper so as to cover a front part of the bottom;

a rear tensioning band made of elastomeric material, which is substantially U-bent and is fixed to a rear part of the shoe-upper so as to cover an area of the shoe-upper immediately above a heel portion of the shoe-upper, and then to extend obliquely along two lateral sides of the shoe-upper towards the sole; and a substantially ribbon-like sagittal tensioning band made of elastomeric material, which extends longitudinally on a bottom part of the shoe-upper, from a tip of the shoe-upper up to the rear tensioning band crossing, in succession, the bottom and the heel portion of the shoe-upper while remaining beneath the sole, and which is firmly fixed to the shoe-upper substantially along its entire length.

2. The climbing shoe according to claim 1, wherein the sagittal tensioning band joins a central segment of the rear tensioning band.

3. The climbing shoe according to claim 1, wherein the sagittal tensioning band has a width (l) which is always locally less than a width of the bottom of the shoe-upper.

4. The climbing shoe according to claim 1, wherein a front ribbon-like segment of the sagittal tensioning band is bent upwards like a hook and is fixed to the shoe-upper so as to protrude from a tarsal phalangeal portion of the bottom and then rise along the tip of the shoe-upper, towards a top fitting opening of the shoe-upper.

5. The climbing shoe according to claim 1, wherein the shoe comprises a front tensioning band made of elastomeric material, which is substantially U-bent and is firmly fixed to the tip of the shoe-upper so as to surround the front part of the bottom of the shoe-upper, firmly joining the sole; the rear tensioning band extending along the two lateral sides of the shoe-upper up to join the front tensioning band.

6. The climbing shoe according to claim 5, wherein two ends of the front tensioning band extend one towards the other along the bottom of the shoe-upper, at a boundary between a tarsus-phalangeal portion and a plantar-arch portion of the bottom, and the sagittal tensioning band extends over ends of the front tensioning band.

7. The climbing shoe according to claim 5, wherein a front ribbon-like segment of the sagittal tensioning band engages a corresponding oblong cut-out made in the front tensioning band, so as to remain in direct contact with the shoe-upper.

8. The climbing shoe according to claim 1, wherein the two ends of the rear tensioning band extend one towards the other along the bottom of the shoe-upper, at a plantar arch portion of the bottom of the shoe-upper, and the sagittal tensioning band extends over ends of the rear tensioning band.

9. The climbing shoe according to claim 1, wherein the sole is shaped and dimensioned so as to cover the tarsus-phalangeal portion and a part of a plantar-arch portion of the bottom of the shoe-upper.

10. The climbing shoe according to claim 1, wherein the shoe comprises a rear protective insert made of soft and flexible polymeric material, which is substantially concave shell-shaped and is firmly fixed to the rear part of the shoe-upper so as to enclose and protect a heel of the foot of the user; the sagittal tensioning band extending over said rear protective insert.

11. The climbing shoe according to claim 10, wherein said rear protective insert is provided with a vertical groove extending substantially straddling a midplane of the shoe, along a part of the rear protective insert that covers the heel portion of the shoe-upper, and is dimensioned so as to be able to accommodate an end part of the sagittal tensioning band.

12. The climbing shoe according to claim 11, wherein the vertical groove of the rear protective insert is dimensioned so as to entirely contain the end part of the sagittal tensioning band.

13. The climbing shoe according to claim 1, wherein the sagittal tensioning band extends on the bottom of the shoe-upper while remaining substantially astride a centerline of a same bottom of the shoe-upper.

14. The climbing shoe according to claim 1, wherein the sagittal tensioning band has a width (l) which is substantially constant along an entire bottom of the shoe-upper.

* * * * *